US009335116B1

(12) United States Patent
Wei

(10) Patent No.: US 9,335,116 B1
(45) Date of Patent: May 10, 2016

(54) CYLINDER ACCOMMODATION MAGAZINE AND TOY GUN USING THE SAME

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 0 days.

(21) Appl. No.: 14/672,682

(22) Filed: Mar. 30, 2015

(51) Int. Cl.

| | |
|---|---|
| ***F41B 11/50*** | (2013.01) |
| ***F41B 11/00*** | (2013.01) |
| ***F41A 9/00*** | (2006.01) |
| ***F41A 9/68*** | (2006.01) |
| ***F41A 9/73*** | (2006.01) |
| ***F41A 9/28*** | (2006.01) |
| ***F41B 11/54*** | (2013.01) |
| ***F41B 11/55*** | (2013.01) |

(52) U.S. Cl.
CPC . *F41B 11/50* (2013.01); *F41A 9/28* (2013.01); *F41A 9/68* (2013.01); *F41A 9/73* (2013.01); *F41B 11/54* (2013.01); *F41B 11/55* (2013.01)

(58) Field of Classification Search
CPC ..... F41B 11/55; F41B 11/54; F41B 11/50; F41A 9/68; F41A 9/28
USPC ..... 124/41.1, 45, 48, 51.1; 42/7, 19, 49.01
See application file for complete search history.

(56) References Cited

U.S. PATENT DOCUMENTS

| | | | | | |
|---|---|---|---|---|---|
| 4,104,819 | A * | 8/1978 | Ferri | F41C 3/10 | 42/58 |
| 4,422,433 | A * | 12/1983 | Milliman | F41B 11/54 | 124/44.7 |
| 4,619,063 | A * | 10/1986 | Hill | F41A 9/68 | 42/19 |
| 4,986,251 | A * | 1/1991 | Lilley | F41B 11/55 | 124/48 |
| 5,261,178 | A * | 11/1993 | Samish | F41A 9/85 | 42/89 |
| 5,845,629 | A * | 12/1998 | Ratliff | F41B 11/89 | 124/56 |
| 6,470,871 | B2 * | 10/2002 | Casas-Salva | F41B 11/54 | 124/48 |
| 6,578,565 | B2 * | 6/2003 | Casas Salva | F41B 11/62 | 124/40 |
| 6,736,125 | B2 * | 5/2004 | Petrosyan | F41B 11/55 | 124/51.1 |
| 6,745,755 | B2 * | 6/2004 | Piccini | F41A 9/28 | 124/49 |
| 6,796,300 | B2 * | 9/2004 | Petrosyan | F41B 11/55 | 124/48 |
| 7,159,584 | B2 * | 1/2007 | Maeda | F41B 11/62 | 124/41.1 |
| 7,395,763 | B1 * | 7/2008 | Vari | F42B 5/24 | 102/529 |
| 7,669,588 | B2 * | 3/2010 | Maeda | F41B 11/54 | 124/74 |
| 7,765,997 | B2 * | 8/2010 | Klockener | F41A 9/76 | 124/48 |
| 7,950,381 | B2 * | 5/2011 | Maeda | F41B 11/54 | 124/45 |
| 7,963,280 | B2 * | 6/2011 | Maeda | F41B 11/54 | 124/45 |
| 8,291,894 | B2 * | 10/2012 | Barwick, Jr. | F41B 11/54 | 124/45 |
| 8,839,706 | B1 * | 9/2014 | Macy | F41B 11/54 | 124/45 |
| 9,134,090 | B1 * | 9/2015 | Park | F41B 11/54 | |
| 2009/0056690 | A1 * | 3/2009 | Maeda | F41B 11/54 | 124/51.1 |

* cited by examiner

*Primary Examiner* — Alexander Niconovich
(74) *Attorney, Agent, or Firm* — Chun-Ming Shih; HDLS IPR Services

(57) ABSTRACT

A cylinder accommodation magazine is provided for containing at least one cylinder. The magazine includes a magazine body and a cylinder chamber. The magazine body includes at least one cylinder container. The cylinder chamber is disposed at one end of the magazine body and away from the at least one cylinder container. A shape of the cylinder chamber conforms to a shape of the at least one cylinder container so as to selectively receive the at least one cylinder, thereby containing more projectiles and achieving easy arrangement of the projectiles.

12 Claims, 5 Drawing Sheets

CYLINDER ACCOMMODATION MAGAZINE AND TOY GUN USING THE SAME

BACKGROUND

1. Technical Field

The present invention relates to a toy gun and, in particular, to a cylinder accommodation magazine, capable of containing more projectiles, and a toy gun using the magazine.

2. Related Art

In conventional toy guns which can shoot plastic projectiles, there are two common types of structures, i.e. pneumatic and mechanical structures. A pneumatic toy gun utilizes an affixed air bottle to provide high pressure air to the toy gun. The plastic projectiles are ejected by the pressure generated by the high pressure air. The mechanical toy gun utilizes the elastic force, generated by stretching of a compressed spring, to push a piston so as to generate high pressure air to eject the plastic projectiles. Because the two types of toy guns operate by different power sources, their structures have obvious differences.

The pneumatic toy gun and the mechanical toy gun operate based on different working principles. In the working principle of the pneumatic toy gun, when triggering a trigger of the pneumatic toy gun, a hammer drives a firing pin to move forward, the firing pin hits a stricken portion disposed inside an upper portion of the magazine to drive the stricken portion to move a piston forward, and the gun is pushed backward to eject the plastic projectile. In an example structure of the mechanical toy gun, the spring is compressed by the piston by means of hand operation, and the movement of the piston generates high pressure air to eject the plastic projectile. Such kind of structure simply provides one single shot, and is less fun to use. There is another structure for the mechanical toy gun, which employs an electric motor to drive the piston by means of a driving mechanism to compress the spring, the mechanical toy gun has a single shot mode and a continuous shooting mode and can be switched to operate in either mode, so it is more fun to use.

In the present product, no matter whether it is a pneumatic or mechanical toy gun, the plastic projectiles loaded in the magazine of the toy gun are usually disposed linearly, and therefore only a small number of the plastic projectiles can be loaded in the toy gun. Furthermore, when loading the plastic projectiles in the magazine, the plastic projectiles are tend to suffer deformation due to the fact that they are easily deformed and are light. Thus, when the plastic projectiles have wrinkles, the pushing force generated by the high pressure air cannot push the plastic projectiles evenly and properly; therefore, the ejection force of the plastic projectiles is insufficient, and consequently, the products lacks flexibility and competitiveness.

In view of the foregoing, the inventor made various studies to improve the above-mentioned problems to overcome the above-mentioned drawback, on the basis of which the present invention is accomplished.

BRIEF SUMMARY

It is one objective of the present invention to provide a cylinder accommodation magazine for containing more projectiles and allowing easy arrangement of the projectiles, and to provide a toy gun using the cylinder accommodation magazine.

Accordingly, the present invention provides a cylinder accommodation magazine for containing at least one cylinder. The magazine includes a magazine body and a cylinder chamber. The magazine body includes at least one cylinder container. The cylinder chamber is disposed at one end of the magazine body and away from the at least one cylinder container. A shape of the cylinder chamber conforms to a shape of the at least one cylinder container so as to selectively receive the at least one cylinder.

In a broad embodiment, the present invention provides a toy gun including a toy gun body and a magazine. The toy gun body includes a grip having a magazine container. The magazine is assembled in the magazine container. The magazine includes a magazine body, at least one cylinder, and a cylinder chamber. The magazine body includes at least one cylinder container. The cylinder is detachably connected to the cylinder container and includes a plurality of projectile chambers arranged circularly. The cylinder chamber is disposed at one end of the magazine body for rotatably disposing the at least one cylinder. A shape of the cylinder chamber conforms to a shape of the cylinder container so as to selectively receive the cylinder.

It is preferable that the toy gun further comprises at least one projectile arrangement member positioned in the at least one cylinder container and respectively disposed corresponding to the at least one cylinder container. The projectile arrangement member includes a through hole and a plurality of cones, wherein the cones are disposed circularly around the through hole.

It is preferable that the magazine body further includes a plurality of guiding pillars and a plurality of positioning protruding points. The guiding pillars are respectively disposed in the cylinder chamber and the at least one cylinder container. Each of the positioning protruding points protrudes from a bottom of the at least one cylinder container, and the positioning protruding points, arranged circularly, surround the guiding pillar. Each cone of the at least one projectile arrangement member is correspondingly inserted in each projectile chamber of the cylinder. The guiding pillar is inserted through the through hole to bring each cone of the projectile arrangement member into engagement with each positioning protruding point.

The present invention further provides the following effects. The first magnet element disposed in the cylinder container or the cylinder chamber and the second magnet element disposed in the cylinder are employed so as to allow the cylinder to be rapidly positioned in the cylinder container or the cylinder chamber, thereby achieving convenient and time-saving replacement of the cylinder.

DETAILED DESCRIPTION

Figure 1:
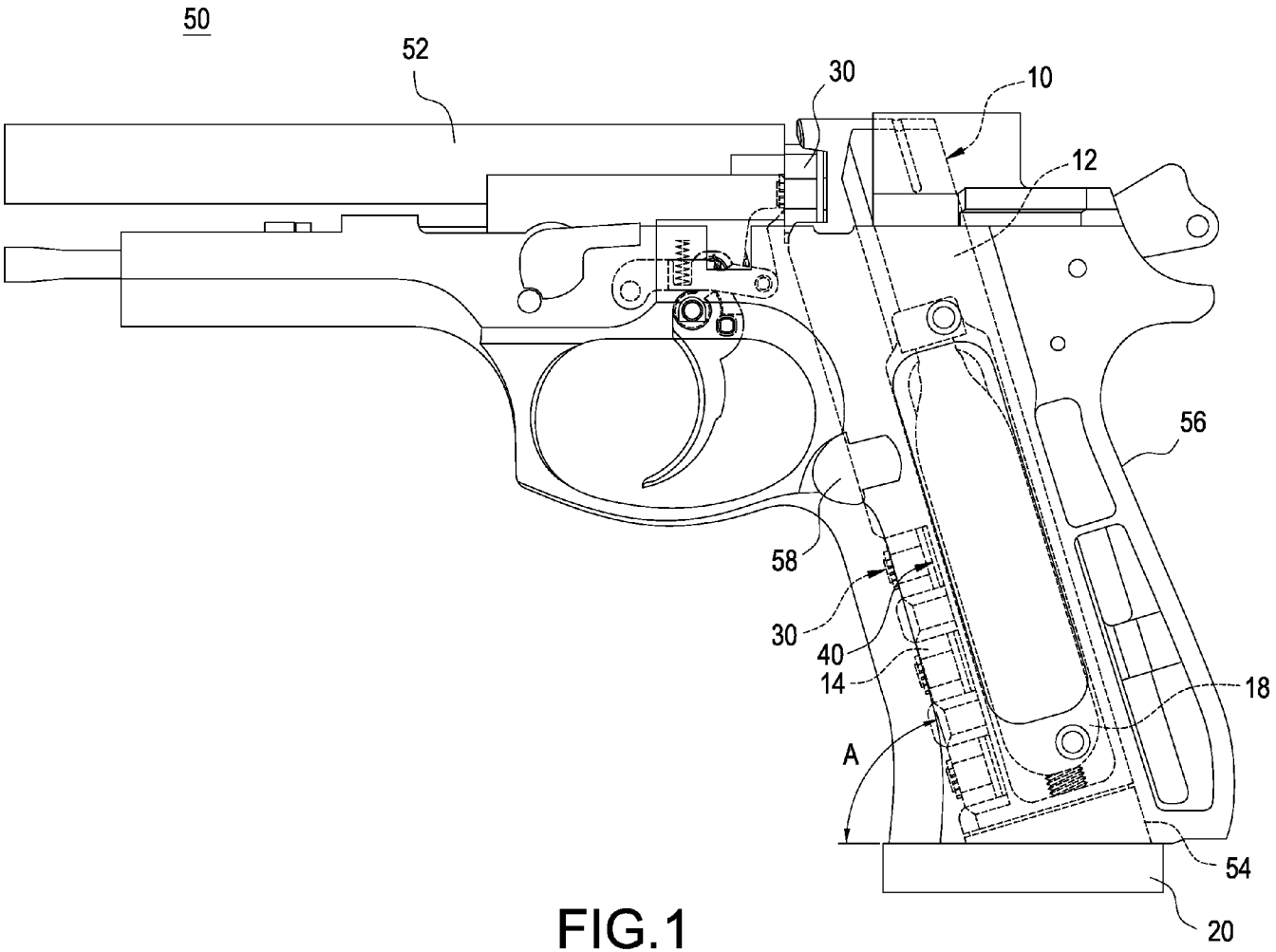
FIG. 1 is a schematic elevation view of a toy gun according to the present invention.
Figure 2:
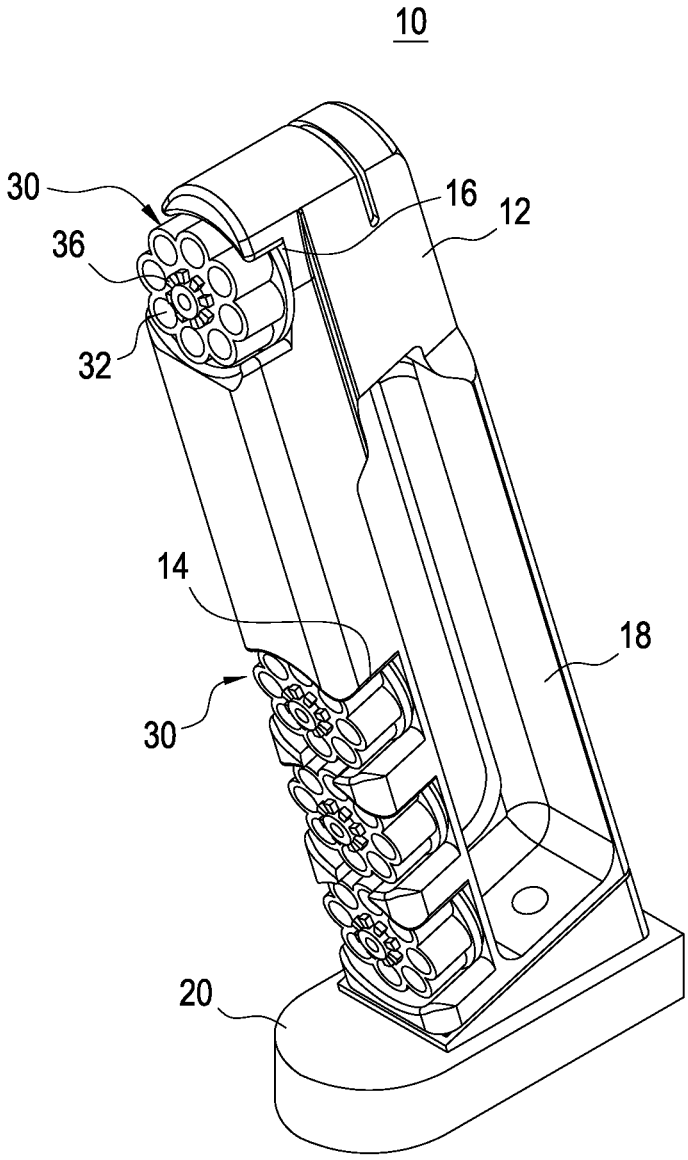
FIG. 2 is a perspective view of a cylinder accommodation magazine according to the present invention.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 5, the present invention provides a cylinder accommodation magazine 10 for containing at least one cylinder 30. The magazine 10 comprises a magazine body 12 and a cylinder chamber 16. The magazine body 12 includes at least one cylinder container 14. The cylinder chamber 16 is disposed at one end of the magazine body 12 and away from the at least one cylinder container 14, wherein a shape of the cylinder chamber 16 conforms to a shape of the at least one cylinder container 14 so as to selectively receive the at least one cylinder 30.

As shown in the figures, the magazine body 10 further includes a reservoir 18 and a base plate 20. The reservoir 18 is provided for installation therein of a high pressure air bottle (not illustrated, e.g. a $CO_2$ bottle or a gas bottle) and is disposed adjacent to the at least one cylinder container 14. However, in other embodiments, the magazine body 10 can includes no reservoir 18 where the high pressure air bottle is installed, depending on practical requirements. The base plate 20 is connected to a bottom of the magazine body 12. One end of the base plate 20 protrudes from one side of the magazine body 12 and together with the magazine body 12 form an included angle A. According to the present embodiment, the included angle A in the present embodiment preferably ranges from 60 degrees to 80 degrees. However, in different embodiments, the angle A can be 90 degrees, and the angle A can vary depending on the types of the toy gun 50. When assembling the magazine body 12 into the magazine container 54 of the toy gun 50, the magazine 10 with the included angle A not only fits to the structure design of the grip 56, but also suits ergonomic design to facilitate easy grip.

Figure 3:
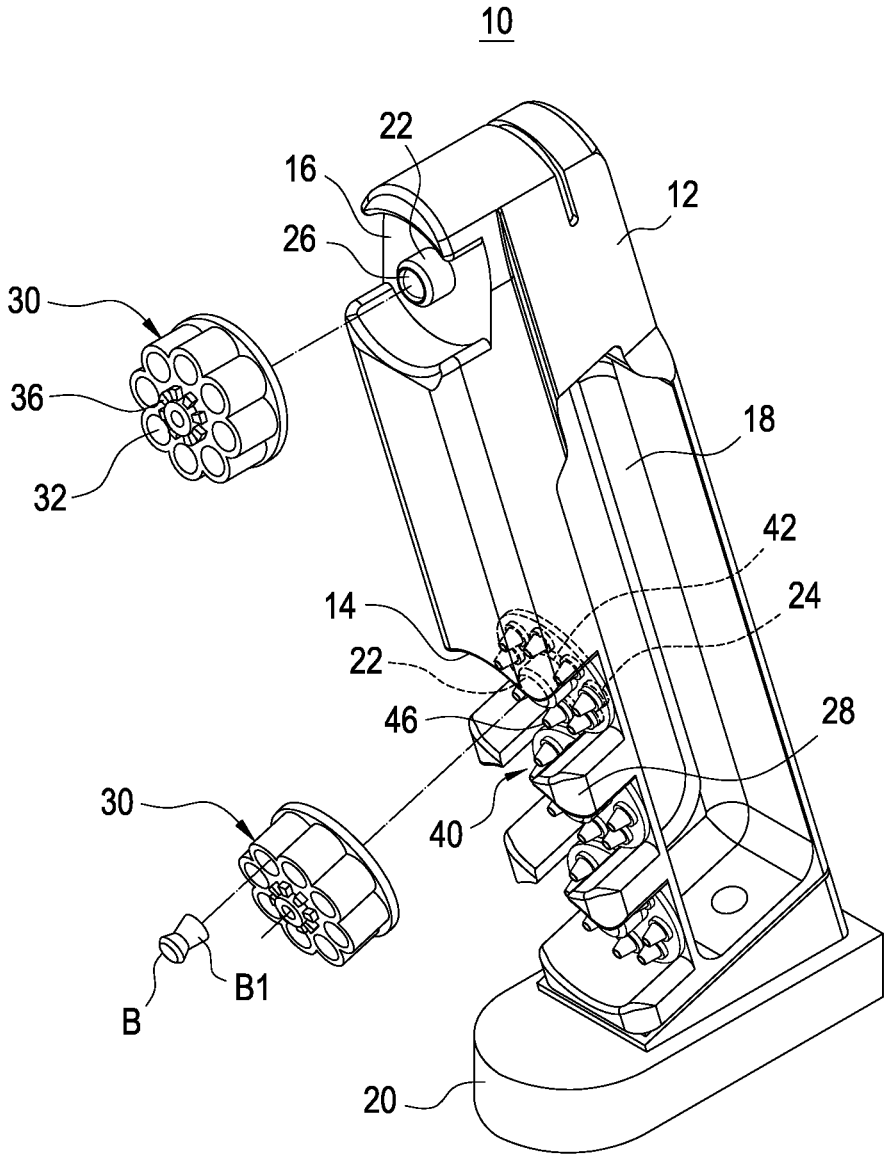
FIG. 3 is an exploded view illustrating assembly of a cylinder into the cylinder accommodation magazine according to the present invention.

According to the present embodiment, it is preferable that the magazine body 12 includes three or more than three cylinder containers 14; however, the present invention is not limited thereto. Referring to FIG. 3, a pair of spacing pillars 28 is disposed between two cylinder containers 14 for spacing the cylinders 30 apart and for disposing the same. The single cylinder chamber 16 and the plurality of the cylinder containers 14 are shaped to conform to a shape of the cylinder 30, and are preferably shaped into a cylindrical shape, but can change in shape to conform to a different shape of the cylinder 30. The cylinder container 14 is oriented in a direction substantially the same as a direction of the cylinder chamber 16, i.e. being oriented in a direction of ejecting the projectiles B. Thus, when pressing a magazine release 58 to remove the magazine body 12, it is convenient and time-saving to replace the cylinder 30. However, in order to increase the number of the loaded projectiles B or achieve other purposes, additional cylinder containers 14 can be added in other places of the magazine body 12, e.g. in the rear of the magazine body 12.

Figure 4:
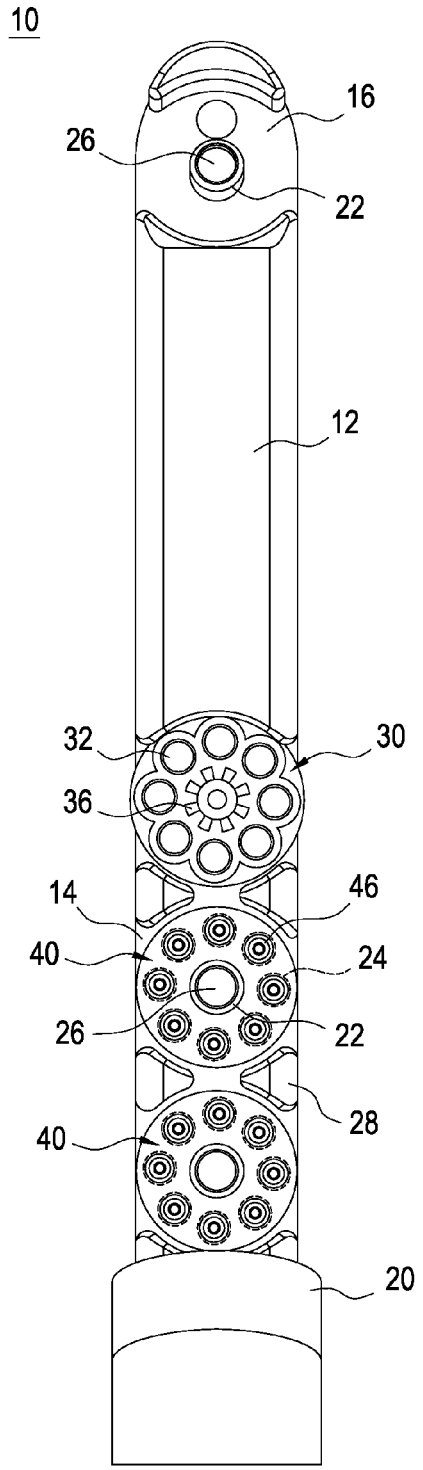
FIG. 4 is a front view of the cylinder accommodation magazine according to the present invention.

Referring to FIGS. 3 and 4, the present invention further includes, integrally formed with the magazine body 12, a plurality of guiding pillars 22 and a plurality of positioning protruding points 24. The guiding pillars 22 are disposed in the cylinder chamber 16 and the cylinder containers 14 respectively, and preferably located in the center of the cylinder chamber 16 and in the center of each cylinder container 14. When the cylinder 30 is assembled into the cylinder chamber 16, it is rotatable around the guiding pillar 22 as an axis. It should be noted that, the cylinder chamber 16 does not include the positioning protruding point 24, or the cylinder 30 cannot rotate. Furthermore, a plurality of engagement portions 36 are disposed on a top surface of each cylinder 30. The number of the engagement portions 36 of each cylinder 30 corresponds to the number of projectile chambers 32 of each cylinder 30. A firing assembly (not illustrated) of the toy gun 50 can rotate the cylinder 30 by using the engagement portions or other elements (not illustrated) so as to fire each projectile B loaded in the corresponding projectile chamber 32.

Figure 5:
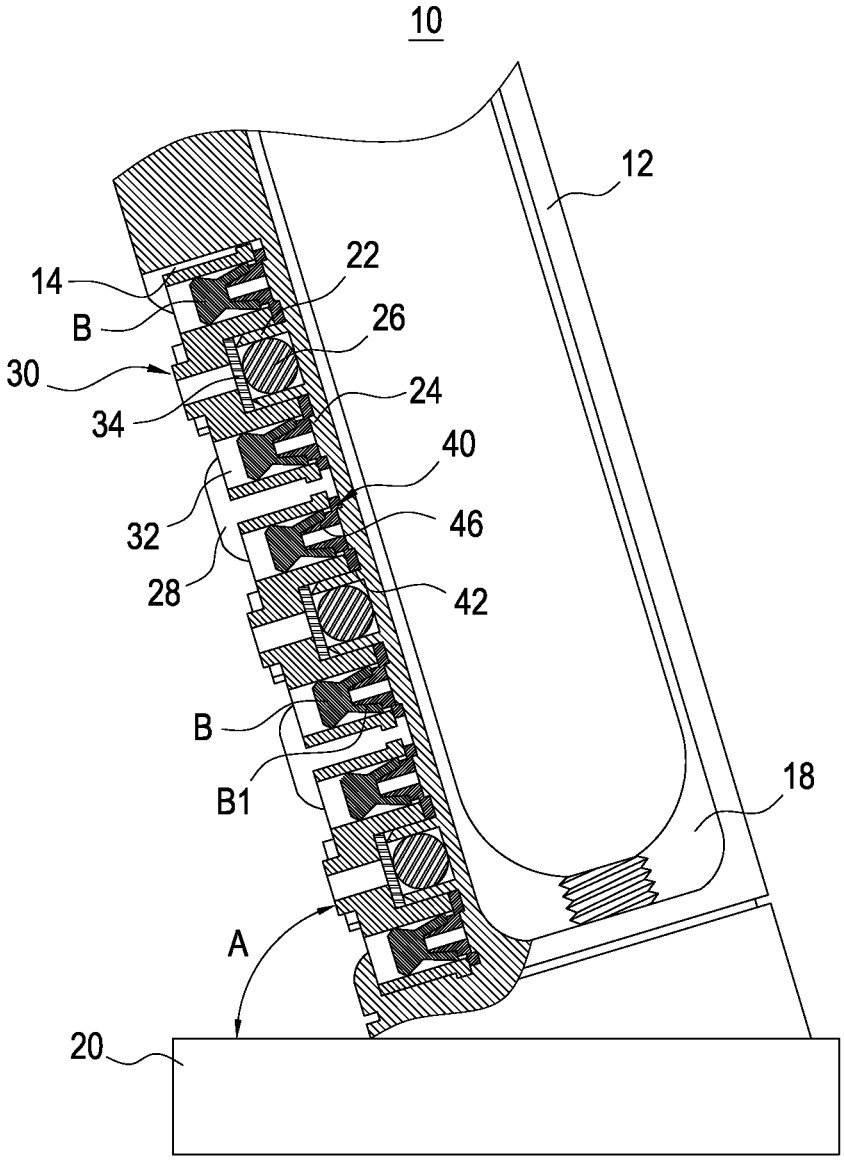
FIG. 5 is a cross-sectional view of the cylinder accommodation magazine according to the present invention.

Each positioning protruding point 24 protrudes out of a bottom of the cylinder container 14, and the positioning protruding points 24, arranged circularly, surround the guiding pillar 22. The embodiment shown in FIG. 3 includes at least one projectile arrangement member 40 disposed in the cylinder container 14. The number of the projectile arrangement members 40 corresponds to the number of the cylinder containers 14; that is to say, each projectile arrangement member 40 is disposed in a respective corresponding one of the cylinder containers 14. The projectile arrangement member 40 includes a through hole 42 and a plurality of cones 46, wherein the cones 46 are disposed circularly around the through hole 42. The guiding pillar 22 is inserted through the through hole 42 to bring each cone 46 of the projectile arrangement member 40 into engagement with each positioning protruding point 24, whereby the horn-shaped projectile B can be inserted through the projectile chamber 32 to engage the cone 46, as shown in FIG. 5. Moreover, when the cylinder 30 is removed from the cylinder container 14, each of the hollow cones 46 is engaged with a respective one of the positioning protruding point 24, and thus is not removed from the cylinder container 14 along with the cylinder 30.

Referring to FIG. 5, since the projectile B has a plastic projectile rim B1 to engage the cone 46, easy arrangement of the projectiles B can be achieved. Each guiding pillar 22 includes a first magnet element 26 disposed therein. The first magnet element 26 is preferably a hard magnet, i.e. a permanent magnet. Certainly, in other embodiments, the first magnet element 26 can be a soft magnet or made of non-magnetic metal such as iron or other metallic alloy. The cylinder 30 includes a second magnet element 34 disposed between each projectile chamber and disposed corresponding to the guiding pillar 22. The second magnet element 34 is preferably a soft magnet or made of non-magnetic metal such as iron or other metallic alloy. Certainly, in other embodiments, the first magnet element 26 and the second magnet element 34 can be interchanged to achieve the same magnetic attraction effect. When the cylinder 30 is replaced or placed in the cylinder container 14 or the cylinder chamber 16, the first magnet element 26 and the second magnet element 34 are magnetically attracted to each other, whereby the cylinder 30 can be positioned in the cylinder container 14 or the cylinder chamber 16, thereby making replacement of the cylinder 30 convenient and time-saving.

In another broad embodiment of the present invention, a toy gun 50 is provided, comprising a toy gun body 52 and a magazine 10. The toy gun body 52 includes a grip 56 including a magazine container 54. The magazine 10 is assembled in the magazine container 54. The magazine body 12 can be removed from the magazine container 54 by pressing the magazine release 58 at one side of the grip 56. The structure of the magazine 10 and the connection relationship thereof are described in the above-mentioned embodiment, and hence detailed descriptions are omitted herein.

As shown in the figures, each cylinder 30 preferably includes 8 projectile chambers 32; however, the present invention is not limited thereto. The number of the projectile chambers 32 corresponds to the number of the positioning protruding points 24, the number of the cones 46 of the projectile arrangement member 40, and the number of the engagement portions 36. In the toy gun 50 of the present invention, when the toy gun 50 includes the cylinder chamber 16 and three cylinder containers 14, the cylinders 30 totally contain thirty two projectiles B. The number of the projectiles B depends on the number of the cylinder containers 14. It should be noted that, when replacing an old cylinder 30 having no projectiles B therein and getting a new cylinder 30 from the cylinder container 14, the projectile arrangement member 40 is engaged with the positioning protruding points 24, so the projectile arrangement member 40 is not removed from the cylinder container 14 along with the cylinder 30.

It is to be understood that the above descriptions are merely preferable embodiment of the present invention and not intended to limit the scope of the present invention. Equivalent changes and modifications made in the spirit of the present invention are regarded as falling within the scope of the present invention.

What is claimed is:

1. A cylinder accommodation magazine, for containing at least one cylinder (30), the magazine (10) comprising:

a magazine body (12) including at least one cylinder container (14);

a cylinder chamber (16) disposed at one end of the magazine body (12) and away from the at least one cylinder container (14), wherein a shape of the cylinder chamber (16) conforms to a shape of the at least one cylinder container (14) so as to selectively receive the at least one cylinder (30); and a plurality of guiding pillars (22) respectively disposed in the cylinder chamber (16) and the at least one cylinder container (14), wherein the magazine body (12) further includes a plurality of positioning protruding points (24), each of the positioning protruding points (24) protrudes from a bottom of the at least one cylinder container (14), and the positioning protruding points (24), arranged circularly, surround the guiding pillar (22).

2. The cylinder accommodation magazine of claim 1, wherein a first magnet element (26) is disposed in each of the guiding pillars (22).

3. The cylinder accommodation magazine of claim 1, wherein the magazine body (12) includes a base plate (20), one end of the base plate (20) protrudes from one side of the magazine body (12), and one end of the base plate (20) and the magazine body (12) together include an included angle (A).

4. The cylinder accommodation magazine of claim 1, wherein the cylinder chamber (16) and the at least one cylinder container (14) are cylindrical shaped.

5. A toy gun (50), comprising:

a toy gun body (52) including a grip (56) including a magazine container (54); and a magazine (10) assembled in the magazine container (54), the magazine (10) comprising:

a magazine body (12) including at least one cylinder container (14);

at least one projectile arrangement member (40) positioned in the at least one cylinder container (14) and respectively disposed corresponding to the at least one cylinder container (14), the at least one projectile arrangement member (40) including a through hole (42) and a plurality of cones (46), wherein the cones (46) are disposed circularly around the through hole (42);

at least one cylinder (30) detachably connected to the at least one cylinder container (14), the at least one cylinder (30) including a plurality of projectile chambers (32) arranged circularly; and a cylinder chamber (16) disposed at one end of the magazine body (12) for rotatably disposing the at least one cylinder (30), wherein a shape of the cylinder chamber (16) conforms to a shape of the at least one cylinder container (14) so as to selectively receive the at least one cylinder (30).

6. The toy gun (50) of claim 5, wherein the magazine body (12) further includes a plurality of guiding pillars (22) and a plurality of positioning protruding points (24), the guiding pillars (22) are respectively disposed in the cylinder chamber (16) and the at least one cylinder container (14), each of the positioning protruding points (24) protrudes from a bottom of the at least one cylinder container (14), and the positioning protruding points (24), arranged circularly, surround the guiding pillar (22).

7. The toy gun (50) of claim 5, wherein each of the cones (46) of the at least one projectile arrangement member (40) is correspondingly inserted in each of the projectile chambers (32) of the at least one cylinder (30).

8. The toy gun (50) of claim 5, wherein the guiding pillar (22) is inserted through the through hole (42) to bring each cone (46) of the projectile arrangement member (40) into engagement with each positioning protruding point (24).

9. The toy gun (50) of claim 5, wherein the at least one cylinder (30) further includes a second magnet element (34) disposed between each projectile chamber (32) and disposed corresponding to the guiding pillar (22).

10. The toy gun (50) of claim 5, wherein each guiding pillar (22) includes a first magnet element (26) disposed therein, whereby the second magnet element (34) can be positioned by magnetic attraction to the first magnet element (26).

11. The toy gun (50) of claim 5, wherein the magazine body (12) further includes a base plate (20), one end of the base plate (20) protrudes from one side of the magazine body (12), and one end of the base plate (20) and the magazine body (12) together include an included angle (A).

12. The toy gun (50) of claim 5, wherein the cylinder chamber (16) and the at least one cylinder container (14) are cylindrical shaped.

* * * * *